US007091140B1

(12) United States Patent
Ferencz et al.

(10) Patent No.: US 7,091,140 B1
(45) Date of Patent: Aug. 15, 2006

(54) HYDROENTANGLEMENT OF CONTINUOUS POLYMER FILAMENTS

(75) Inventors: Rick Ferencz, Isle of Palms, SC (US); Michael Putnam, Charlotte, NC (US); Jian Weng, Charlotte, NC (US)

(73) Assignee: Polymer Group, Inc., North Charleston, SC (US)

( * ) Notice: Subject to any disclaimer, the term of this patent is extended or adjusted under 35 U.S.C. 154(b) by 0 days.

(21) Appl. No.: 09/287,673

(22) Filed: Apr. 7, 1999

(51) Int. Cl.

| | |
|---|---|
| ***D04H 1/46*** | (2006.01) |
| ***D04H 3/10*** | (2006.01) |
| ***D04H 5/02*** | (2006.01) |
| ***D04H 3/16*** | (2006.01) |

(52) U.S. Cl. ..... 442/408; 442/401; 428/222; 428/903

(58) Field of Classification Search ..... 442/401, 442/408; 428/222, 903
See application file for complete search history.

(56) References Cited

U.S. PATENT DOCUMENTS

| | | | | | |
|---|---|---|---|---|---|
| 2,862,251 | A | | 12/1958 | Kalwaites | |
| 3,042,576 | A | | 7/1962 | Harmon et al. | |
| 3,113,349 | A | | 12/1963 | Nottebohm et al. | |
| 3,129,466 | A | | 4/1964 | L'Hommedieu | |
| 3,214,819 | A | | 11/1965 | Cuerin | |
| 3,403,862 | A | | 10/1968 | Dworjanyn | |
| 3,485,706 | A | | 12/1969 | Evans | |
| 3,486,186 | A | | 12/1969 | Richards et al. | |
| 3,493,462 | A | | 2/1970 | Bunting, Jr. et al. | |
| 3,494,821 | A | * | 2/1970 | Evans | |
| 3,508,308 | A | | 4/1970 | Bunting, Jr. et al. | |
| 3,560,326 | A | | 2/1971 | Bunting, Jr. et al. | |
| 3,692,618 | A | | 9/1972 | Dorschner et al. | |
| 4,107,374 | A | | 8/1978 | Kusunose et al. | |
| 4,476,186 | A | | 10/1984 | Kato et al. | |
| 4,560,385 | A | | 12/1985 | Baravian | |
| 4,668,566 | A | | 5/1987 | Braun | |
| 4,774,110 | A | | 9/1988 | Murakami et al. | |
| 4,808,467 | A | * | 2/1989 | Suskind et al. | 428/284 |
| 4,818,594 | A | | 4/1989 | Albien et al. | |
| 4,839,216 | A | | 6/1989 | Curro et al. | |
| 4,997,611 | A | | 3/1991 | Hartmann | |
| 5,009,747 | A | | 4/1991 | Vaizmensky et al. | |
| 5,023,130 | A | | 6/1991 | Simpson et al. | |
| 5,142,750 | A | | 9/1992 | Dyer et al. | |
| 5,142,753 | A | | 9/1992 | Bolliand et al. | |
| 5,151,320 | A | * | 9/1992 | Homonoff et al. | 442/384 |
| 5,240,764 | A | | 8/1993 | Haid et al. | |
| 5,244,711 | A | | 9/1993 | Drelich et al. | |
| 5,290,626 | A | | 3/1994 | Nishioi et al. | |
| 5,355,565 | A | | 10/1994 | Baravian | |
| 5,369,858 | A | | 12/1994 | Gilmore et al. | |
| 5,482,772 | A | | 1/1996 | Strack et al. | |
| 5,573,841 | A | * | 11/1996 | Adam et al. | 428/219 |
| 5,632,072 | A | | 5/1997 | Simon et al. | |
| 5,635,290 | A | | 6/1997 | Stopper et al. | |
| 5,840,633 | A | | 11/1998 | Kurihara et al. | |
| 5,888,916 | A | | 3/1999 | Tadokoro et al. | |
| 5,899,785 | A | | 5/1999 | Groten et al. | |
| 5,970,583 | A | | 10/1999 | Groten et al. | |
| 6,306,234 | B1 | * | 10/2001 | Barker et al. | 156/148 |
| 6,321,425 | B1 | * | 11/2001 | Putnam et al. | 28/104 |
| 6,430,788 | B1 | * | 8/2002 | Putnam et al. | 28/104 |
| 2002/0025753 | A1 | * | 2/2002 | Putnam et al. | 442/340 |
| 2003/0211801 | A1 | * | 11/2003 | Putnam et al. | 442/387 |

FOREIGN PATENT DOCUMENTS

| | | |
|---|---|---|
| EP | 0 308 320 | 3/1989 |
| EP | 0 900 869 | 3/1999 |

OTHER PUBLICATIONS

"Advanced Fiber Spinning Technology", edited by Professor T. Nakajima, Japanese Edition first published 1992, pp. 104–128, pp. 186–206, pp. 224–252.
Supplemental European Search Report, dated Mar. 31, 2004, European Application No. EP 01 27 3236, 4 pages.

* cited by examiner

*Primary Examiner*—Terrel Morris
*Assistant Examiner*—Norca L. Torres
(74) *Attorney, Agent, or Firm*—Wood, Phillips, Katz, Clark & Mortimer

(57) ABSTRACT

A nonwoven fabric comprises continuous polymer filaments of 0.5–3 denier that have been hydroentangled in a complex matrix of interconnecting filament loops, and that is otherwise substantially free of knotting, or of otherwise wrapping about one another. A process for making a non-woven fabric comprises continuously extruding polymer filaments of 0.5–3 denier onto a moving support, pre-entangling the filaments with water jets, and entangling filaments with a second set of water jets. An apparatus for making a non-woven fabric comprises means for continuously extruding substantially endless polymer filaments of 0.5–3 denier onto a moving support to form an unbonded web, a pre entangling station for entangling the web with a plurality of water jets, and a plurality of water jets for final entanglement of the filament web.

10 Claims, 11 Drawing Sheets

Figure 8: Prior Art

FIG. 12

TABLE I:
Spinlace™ Fabric Analysis
Fabric properties vs. Control Fabrics

| ID | type | basis weight | denier | water jets | | | | | | | total energy | Entanglement | | Fiber | Grab Tensile | | Tear Trap | | Abrasion | Strip Tensiles, # | | Elongation | | Density |
|---|---|---|---|---|---|---|---|---|---|---|---|---|---|---|---|---|---|---|---|---|---|---|---|---|
| | | | | process/pattern | jet pressures | | | | | | | | | | | | | | | | | | | |
| | | | | | 1 | 2 | 3 | 4 | 5 | 6 | HP-hr/lb. | completeness | frequency | interlock | CD | MD | CD | MD | cycles | CD | MD | CD | MD | g/cm^3 |
| W | TBCW | 34 | 2 | | | | | | | | | 1.04 | 45.43 | 9.66 | 10 | 22 | 3 | 9 | 54 | 1 | 5 | 58 | 49 | 0.14 |
| X | TBCW | 68 | 2 | | | | | | | | | 0.98 | 52.03 | 19.15 | 25 | 37 | 7 | 15 | 18 | 4 | 7 | 52 | 51 | 0.45 |
| 106 | Spinlace | 34 | 1.67 | flatbed & roll | 100 | 1200 | 1200 | 800 | 1600 | 1600 | 1.1 | 0.85 | 34.40 | 46.29 | 29 | 50 | 16 | 25 | 40 | 4 | 13 | 118 | 117 | 0.06 |
| 401A | Spinlace | 34 | 1.67 | Apex 33x28 | | | | | | | 1.6 | 1.17 | 11.86 | 45.22 | | | | | | 2.9 | 4.9 | | | 0.06 |
| 103 | Spinlace | 68 | 1.67 | flatbed & roll | 100 | 1600 | 1600 | 1600 | 1600 | 1600 | 0.7 | 1.18 | 9.72 | 40.42 | 81 | 116 | 34 | 55 | 5 | 6 | 14 | 137 | 120 | 0.17 |
| 402A | Spinlace | 68 | 1.67 | tricot sleeve | | | | | | | 1.9 | 1.10 | 9.91 | 41.30 | | | | | | 5.8 | 6.6 | | | 0.08 |
| 102 | Spinlace | 68 | 3 | flatbed & roll | 100 | 1600 | 1600 | 1600 | 1600 | 1600 | 0.7 | 1.18 | 12.46 | 21.34 | | | | | | 2.1 | 4 | | | 0.06 |
| 402C | Spinlace | 68 | 3 | tricot sleeve | | | | | | | 1.9 | 1.10 | 13.38 | 35.13 | | | | | | 2.4 | 8.2 | | | 0.05 |
| 302 | Spinlace | 100 | 3 | flatbed & roll | 100 | 1600 | 1700 | 1700 | 1700 | 1700 | 0.5 | 1.12 | 13.91 | 19.70 | | | | | | 4.37 | 5.8 | | | 0.07 |
| 403B | Spinlace | 100 | 3 | NCSU sleeve | | | | | | | 1.9 | 1.13 | 14.22 | 20.19 | | | | | | 4.5 | 8.3 | | | 0.07 |
| Y | SB | 34 | 1.67 | | | | | | | | | 0.98 | 103.89 | 37.33 | 24 | 47 | 4 | 9 | 36 | 3 | 10 | 39 | 37 | 0.15 |
| Z | SB | 68 | 1.67 | | | | | | | | | 0.79 | 26.36 | 32.46 | 32 | 51 | 14 | 24 | 10 | 3 | 8 | 33 | 20 | 0.52 |
| 201 | HET | 34 | 2.2 | flatbed & roll | 100 | 600 | 1200 | 800 | 1600 | 1600 | | 0.58 | 19.07 | 17.42 | 10 | 20 | 5 | 11 | 28 | 1 | 5 | 127 | 103 | 0.05 |
| 401B | HET | 34 | 2.2 | Apex 33x28 | | | | | | | | 1.15 | 15.33 | 21.09 | | | | | | 1.01 | 2.35 | | | 0.06 |
| 204 | HET | 68 | 2.2 | flatbed & roll | 100 | 600 | 1200 | 1600 | 1600 | 1600 | | 0.86 | 17.45 | 22.21 | 42 | 58 | 6 | 16 | 5 | 3 | 8 | 128 | 111 | 0.18 |
| 402B | HET | 68 | 2.2 | tricot sleeve | | | | | | | | 1.13 | 19.54 | 25.93 | | | | | | 2.9 | 3.8 | | | 0.06 |

notes
TBCW = thermally point bonded carded webs
Spinlace™ fabric = water jet entangled continuous filament webs
SB = thermally point bonded spunbond
HET = hydroentangled carded staple fiber webs

HYDROENTANGLEMENT OF CONTINUOUS POLYMER FILAMENTS

BACKGROUND OF THE INVENTION

This invention relates to a method for hydroentanglement of continuously extruded essentially endless thermoplastic polymer filaments, the apparatus for carrying out the method, and the products produced thereby.

The term "hydroentanglement" refers to a process that was developed in the 1950's and earlier as a possible substitute for a conventional weaving process. In a hydroentanglement process, small, high intensity jets of water are impinged on a layer of loose fibers, with the fibers being supported on an unyielding perforated surface, such as a wire screen or perforated drum. The liquid jets cause the fibers, being relatively short and having loose ends, to become rearranged, with at least some portions of the fibers becoming tangled, wrapped, and/or knotted around each other. Depending on the nature of the support surface being used (e.g. the size, shape and pattern of openings), a variety of fabric arrangements and appearances can be produced, such as a fabric resembling a woven cloth or a lace.

The term "spunbonding" refers to a process in which a thermoplastic polymer is provided in a raw or pellet form and is melted and extruded or "spun" through a large number of small orifices to produce a bundle of continuous or essentially endless filaments. These filaments are cooled and drawn or attenuated and are deposited as a loose web onto a moving conveyor. The filaments are then partially bonded, typically by passing the web between a pair of heated rolls, with at least one of the rolls having a raised pattern to provide a bonding pattern in the fabric. Of the various processes employed to produce nonwovens, spunbonding is the most efficient, since the final fabric is made directly from the raw material on a single production line. For nonwovens made of fibers, for example, the fibers must be first produced, cut, and formed into bales. The bales of fibers are then processed and the fibers are formed into uniform webs, usually by carding, and are then bonded to make a fabric.

Hydroentangled nonwoven fabrics enjoy considerable commercial success primarily because of the variety of fiber compositions, basis weights, and surface textures and finishes which can be produced. Since the fibers in the fabric are held together by knotting or mechanical friction, however, rather than by fiber to fiber fusion or chemical adhesion, such fabrics offer relatively low tensile strength and poor elongation. In order to overcome these problems, proposals have been advanced to entangle the fibers into an already existing separate, more stable substrate, such as a preformed cloth or array of filaments, where the fibers tend to wrap around the substrate and bridge openings in the separate substrate. Such processes obviously involve the addition of a secondary fabric to the product, thereby increasing the associated effort and cost.

Another method for improving strength properties is to impregnate the fabric with adhesive, usually by dipping the fabric into an adhesive bath with subsequent drying of the fabric. In addition to adding cost and effort to the process, however, addition of an adhesive may undesirably affect other properties of the final product. For instance, treatment with an adhesive may affect the affinity of the web for a dye, or may otherwise cause a decline in aesthetic properties such as hand and drape as a result of increased stiffness.

Because of the above discussed problems associated with hydroentangled webs, the hydroentangling practice as known by those skilled in the art heretofore has been limited only to staple fibers, to pre-bonded webs, or to filaments of only an extremely small diameter. The hydroentanglement of webs of filaments that are continuous, of larger diameter, or higher denier has heretofore not been considered feasible. Conventional wisdom suggests that long, large diameter, continuous filaments would dissipate energy supplied by entangling water jets, and thereby resist entanglement. An additional factor suggesting that continuous filaments could not be sufficiently hydroentangled to form a stable, cohesive fabric is that as the filaments are continuous they do not have loose free ends required for wrapping and knotting. Yet another problem in the hydroentangling process as presently known and practiced in the industry is associated with production speed limitations. Presently known methods and apparatuses for hydroentangling filaments are not able to achieve rates of production equal to those of spunbonding filament production.

There is therefore an as yet unresolved need in the industry for a process of hydroentangling continuous filaments of relatively large denier. Also, there is a heretofore unresolved need in the industry for a hydroentangled nonwoven fabric comprised of continuous filaments of relatively large denier. Further, there is an unresolved need in the industry for an apparatus for producing a nonwoven web comprised of hydroentangled continuous filaments of relatively large denier, and for a method and apparatus for hydroentanglement capable of rates of production substantially equal to spunbonding production rates.

Objects of the Invention

It is an object of the present invention to provide a hydroentangled nonwoven fabric comprised of continuous filaments of relatively large denier.

It is a further object of the present invention to provide a process and apparatus for hydroentangling continuous filaments of relatively large denier at rates of production substantially equal to rates of spunbonding production.

It is a still further object of the invention to provide an apparatus for producing a nonwoven web comprised of hydroentangled continuous filaments of relatively large denier.

SUMMARY OF THE INVENTION

The present invention comprises a process for making a nonwoven fabric in which a large number of continuous or essentially endless filaments of about 0.5 to 3 denier are deposited on a moving support to form an unbonded web, which is then continuously and without interruption subjected to hydroentanglement in stages by water jets to form a fabric. The hydroentanglement process of the present invention is capable of production rates substantially equal to those of the spunbonding process. The present invention also provides a nonwoven fabric comprised of hydroentangled continuous filaments of 0.5–3 denier, wherein the filaments are interengaged by a matrix of packed continuous complex loops or spirals, with the filaments being substantially free of any breaking, wrapping, knotting, or severe bending. The present invention further comprises an apparatus for making a non-woven fabric, comprising means for depositing continuous filaments of 0.5–3 denier on a moving support, and at least one successive group of water jets for hydroentangling the fibers wherein the filaments are interengaged by continuous complex loops or spirals, with the filaments being substantially free of any wrapping, knotting, or severe bending.

The preferred nonwoven fabric of the present invention comprises a web of continuous, substantially endless polymer filaments of 0.5–3 denier interengaged by continuous complex loops or spirals, with the filaments being substantially free of any wrapping, knotting, breaking, or severe bending. The terms "knot" and "knotting" as used in the description and claims of this invention are in reference to a condition in which adjacent fibers or filaments in a hydroentangled web pass around each other more than about 360° to form mechanical bonds in the fabric.

The fabric of the invention, because of the unique manner in which the filaments are held together, provides excellent tensile strength and high elongation. This is a most surprising result, as it is well known in the industry that with the exception of elastic non-woven fabrics, there is an inverse relationship between tensile strength and elongation values. High strength fabrics tend to have lower elongation than fabrics of comparable weight and lower tensile strength.

The surprising high elongation and high tensile strength combination of the present fabric and process results from the novel filament entanglement. As opposed to fiber knotting and extensive wrapping of the prior art, the physical bonding of the continuous filaments of the present invention is instead characterized by complex meshed coils, spirals, and loops having a high frequency of contact points. This novel filament mechanical bonding provides high elongation values in excess of 90% and more typically in excess of 100% in combination with high tensile strength as the meshed coils and loops of the invention disengage and filaments straighten and elongate under a load. Knotted fibers of the prior art, on the other hand, tend to suffer fiber breakage under load, resulting in more limited elongation and tensile strengths.

The effect of the novel packed loops of the fabric and process of the invention also results in a distinctive and commercially advantageous uniform fabric appearance. The individual fiber wrapping and knotting of prior art hydroentangled fabrics leads to visible streaks and thin spots. The complex packing of the loops and coils of the present invention, on the other hand, provides better randomization of the filaments, resulting in a more consistent fabric and better aesthetics. Because the novel packing of the filaments of the invention is substantially free of loose filament ends, the fabric of the invention also advantageously has high abrasion resistance and a low fuzz surface.

The preferred process of the present invention includes melt extruding at least one layer of continuous filaments of 0.5–3 denier onto a moving support to form a web, continuously and without interruption pre-entangling the web with at least one pre-entanglement water jet station having a plurality of water jets, and finally entangling the filament web with at least one entanglement water jet station to form a coherent web. The pre-entangling water jets are preferably operated at a hydraulic pressure of between 100–5000 psi, while the entangling water jets are operated at pressures of between 1000–6000 psi. Hydraulic pressures used will depend on the basis weight of the fabric being produced, as well as on qualities desired in the fabric, as will be discussed in detail below.

Contrary to conventional wisdom, it has been found that an unbonded web of continuous and essentially endless filaments of relatively large denier may be produced on a modern high speed spunbond line. Such a web may be produced as the continuous filaments have sufficient curvature and mobility, while being somewhat constrained along their length, to allow entanglement in the unique manner of the invention. The dynamics of the interengaged packed loops of the fabric of the invention are thus entirely different from the hydroentanglement of staple fibers of the same denier.

The preferred apparatus of the present invention comprises a means for continuously depositing substantially endless filaments of 0.5–3 denier on a moving support to form a web, and at least one water jet station for hydroentangling the filament web. Preferably, at least one preliminary water jet pre-entangling station is also provided. The moving support preferably comprises a porous single or dual wire, or a forming drum. An additional water jet station and an additional forming drum may further be provided in the preferred embodiment of the apparatus for impinging a pattern on the fabric. Also, a preferred apparatus embodiment may further comprise means for introducing a second component filament, such as staple fibers, pulp, or melt-blown webs, to the web of the invention, as a subsequent step.

The above brief description sets forth rather broadly the more important features of the present invention so that the detailed description that follows may be better understood, and so that the present contributions to the art may be better appreciated. There are, of course, additional features of the disclosure that will be described hereinafter which will form the subject matter of the claims appended hereto. In this respect, before explaining the several embodiments of the disclosure in detail, it is to be understood that the disclosure is not limited in its application to the details of the construction and the arrangements set forth in the following description or illustrated in the drawings. The present invention is capable of other embodiments and of being practiced and carried out in various ways, as will be appreciated by those skilled in the art. Also, it is to be understood that the phraseology and terminology employed herein are for description and not limitation.

BRIEF DESCRIPTION OF THE FIGURES

FIG. 12 compares measured values between various non-woven fabrics of the invention and various prior art non-woven fabrics.

DETAILED DESCRIPTION

Figure 1:
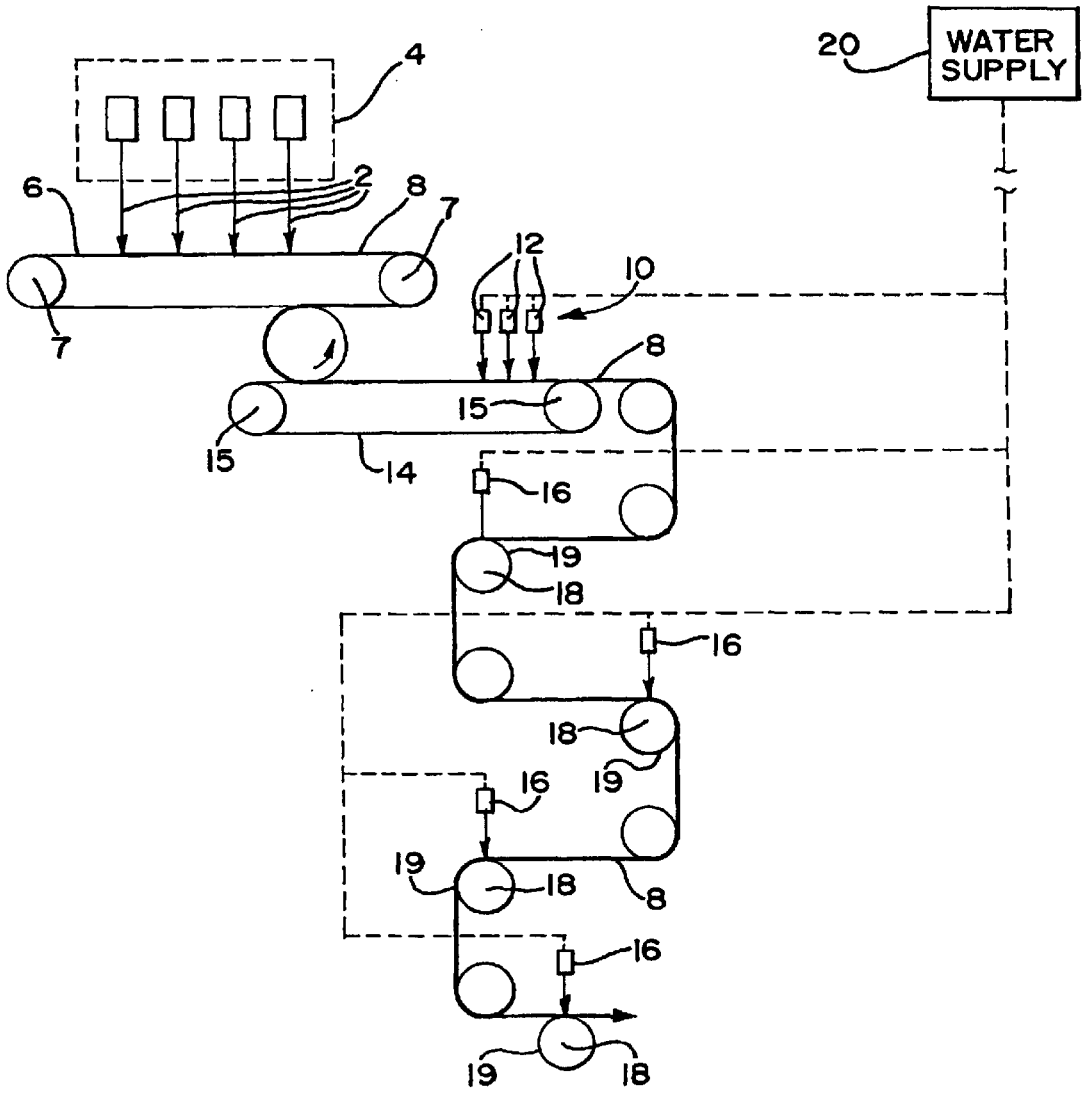
FIG. 1 is a schematic view of one embodiment of the invention.

Turning now to the drawings, FIG. 1 illustrates a first embodiment of the process and apparatus of the invention Continuous filaments 2 are melt extruded, drawn, and then deposited by beam 4 on moving porous support wire 6 winding on rollers 7 to form an unbonded filament web 8. After drawing, filaments 2 have a denier of between about 0.5–3, with a most preferred denier of 1–2.5, and are preferably comprised of a melt a extruded thermoplastic polymer, such as a polyester, polyolefin (such as polypropylene), or polyamide. As filaments 2 are continuously extruded, they are substantially endless. Deposited, unbonded filament web 8 is relatively fragile, thin, and easily disturbed. Web 8 may be comprised of more than one layer of filaments 2. The dominant orientation of filaments 2 is in the machine direction, with some degree of overlap in the cross direction. If desired, a variety of techniques may be employed to encourage further separation of individual filaments 2 and greater randomness in the cross direction. These techniques may include, but are not limited to, impinging filaments 2 with air currents, electrostatic charging, or contact with solid objects. Also, as is well known in the art, vacuum may be drawn through support wire 6 in the area of depositing filaments 2.

Web 8 is continuously and substantially without interruption advanced to pre-entangling station 10 for pre-entanglement with a plurality of individual pre-entangling jets 12 that direct water streams of a hydraulic pressure onto web 8. Preferably, pre-entangling station 10 comprises from one to four sets of pre-entangling jets 12, with one to three most preferred. Preferred pre-entangling jets 12 operate at hydraulic pressures between 100 to 5000 psi, and have orifice diameters ranging from 0.004–0.008", with 0.005–0.006" most preferred. Jets 12 further have a hole orifice density of from 10–50 holes per inch in the cross direction, with at least 20 per inch most preferred. The number of individual jet streams per jet 12 will vary with the width of web 8; jet 12 will extend substantially across the width of web 8, with individual jet streams at a density of 10–50 per inch. The pressures of individual pre-entangling jets 12 may vary as desired depending on fabric basis weight and desired pattern. For pre-entangling a web 8 with a basis weight of no greater than 50 gm/m$^2$, for instance, a preferred pre-entangling station 10 will comprise three individual sets of jets 12 operating sequentially at pressures of 100, 300, and 800 psi. A preferred pre-entangling station 10 for a web 8 of a basis weight greater than 50 gm/m$^2$ will comprise three individual sets of water jets 12 operating respectively at pressures of 100, 500, and 1200 psi.

During pre-entanglement, web 8 is supported on moving support 14, which may comprise a forming drum, or, as illustrated, a single or dual wire mesh rotating about rollers 15. Because filaments 2 are substantially endless and of considerable denier, support 14 need not be of fine mesh as may be required for shorter or finer fibers of the prior art. For high pre-entanglement hydraulic pressures associated with heavier basis weight fabrics, supporting web 8 on a rotating forming drum is preferred. The purpose of pre-entanglement is to create some cohesiveness in web 8 so that web 8 can be transferred and will not be destroyed by the energy of subsequent high pressure hydroentanglement. After pre-entangling, web 8 is observed to have minimal entanglement and low strength values.

After pre-entangling, the continuously moving web 8 is next subjected to high pressure hydroentangling. High pressure hydroentangling may be achieved at a hydroentanglement station that comprises a plurality of sets of water jets 16. High pressure jets 16 for entangling preferably are directed at the "backside" of web 8 opposite the "frontside" onto which pre-entangling jets were directed. Or, as shown in FIG. 1, high pressure jets 16 may alternately be directed at one and then the opposite side of web 8. High pressure water jets 16 operate at hydraulic pressures of between 1000 to 6000 psi. For webs of basis weight at or below 50 gm/m$^2$, one to four sequential high pressure jets 16 are preferred, operating at pressures between 1000–2000 psi with 1600 psi most preferred. For webs of basis weight greater than 50 gm/m$^2$, one to four sequential high pressure jets 16 are preferred operating at pressures between 3000 and 6000 psi. Preferred high pressure jets 16 have an orifice diameter of from 0.005–0.006", and have a hole orifice density of from 10–50 holes per inch in the cross direction, with at least 20 per inch most preferred. The number of individual jet streams will vary with the width of web 8; jets impinge web 8 across substantially its entire width with individual streams at a density of 10–50 holes per inch.

When high pressure hydroentanglement is carried out at hydrostatic pressures greater than 1600 psi, web 8 is preferably supported on rotating forming drum 18. Drums 18 preferably have a patterned 3-dimensional surface 19 to control the X-Y spatial arrangement in the plane of filaments 2, as well as in the z direction (web thickness).

Both pre-entanglement jets 12 and entanglement jets 16 may be supplied by a common remote water supply 20, as illustrated in FIG. 1. Water temperature may be ambient. Spacing between both pre-entanglement jets 12 and entanglement jets 16 and web 8 is preferably between 1–3 inches. It is also noted that the distance between individual jet stations, and hence the time elapsed between impinging web 8 with jet streams, is not critical. In fact, web 8 may be stored after pre-entangling with pre-entanglement jets 12 for later entanglement, although the preferred process is continuous.

A major limitation in prior art practices is the ability to operate a hydroentanglement line for a web of fibers at a high rate of speed such as the line speed of a modern spunbond line. The use of high water pressures and hence high energy levels would be expected to cause the fiber to be driven excessively into screens of standard mesh size, or to cause undue displacement of the fibers. It has been found in accordance with the present invention that much higher energies can be used in the entanglement station while using standard mesh size screens, allowing for an increase in line speeds comparable to the normal line speed of the spunbond line. Thus there is no need for for an accumulator or other means to act as a "buffer" between filament production and final entangled web output or for support screens of fine mesh as may be required by processes and apparatuses of the prior art. As an example of the above, 3 denier polypropylene filament webs are subjected to an energy of 1.5 to 2 horsepower hours per pound (HP-hr/lb) in the high pressure entanglement stations. Other examples are 0.4 to 0.75 HP-hr/lb for 1.7 denier polypropylene and 0.3–0.5 HP-hr/lb for 2 denier polyester filaments. If a final patterning operation is employed, the energy levels are approximately double those described above.

Figure 2:
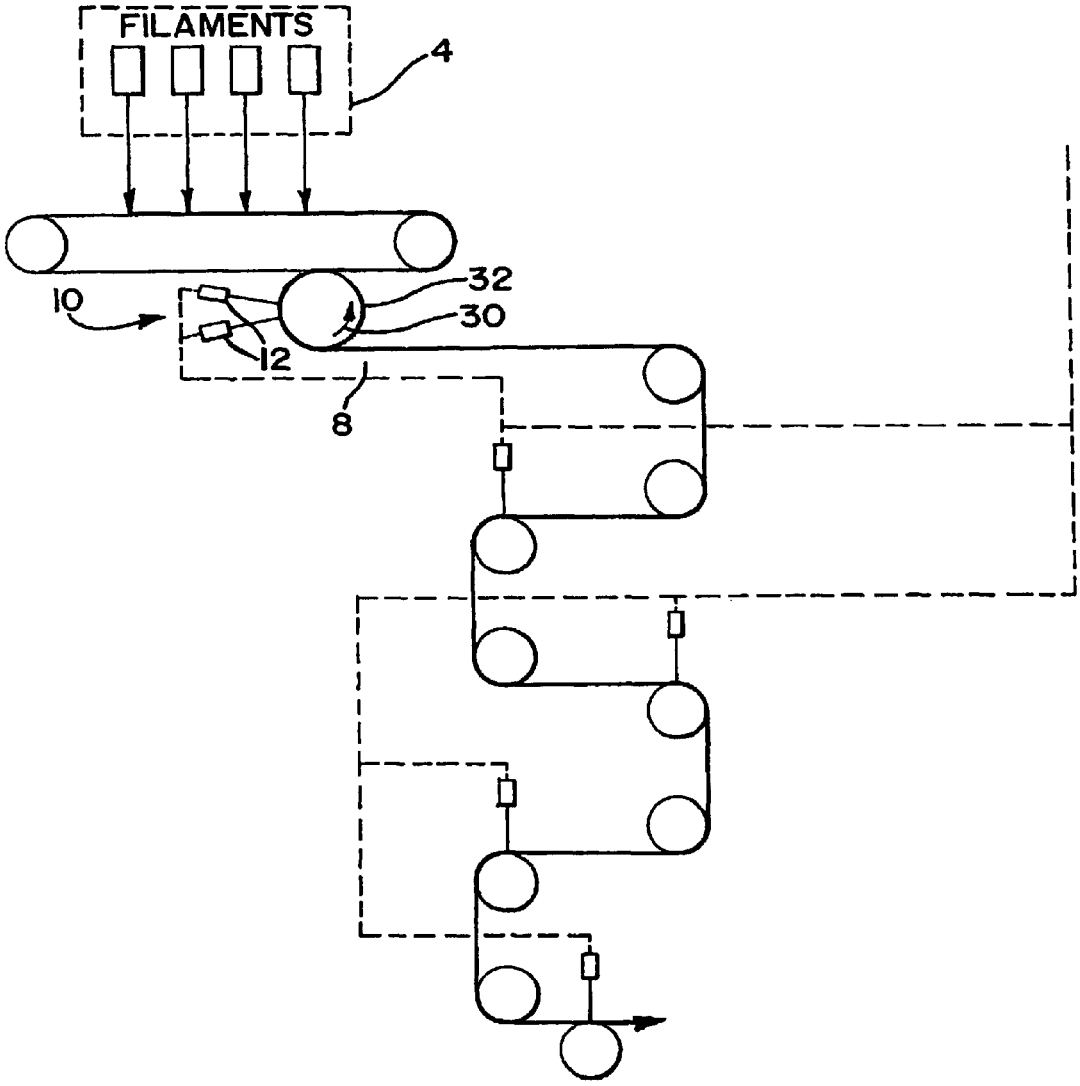
FIG. 2 is a schematic view of another embodiment of the invention.
Figure 3B:
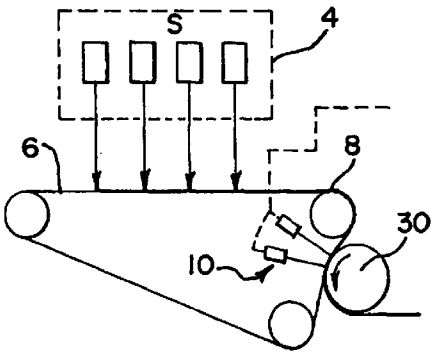
FIG. 3B is a schematic view of another embodiment of the invention.
Figure 3D:
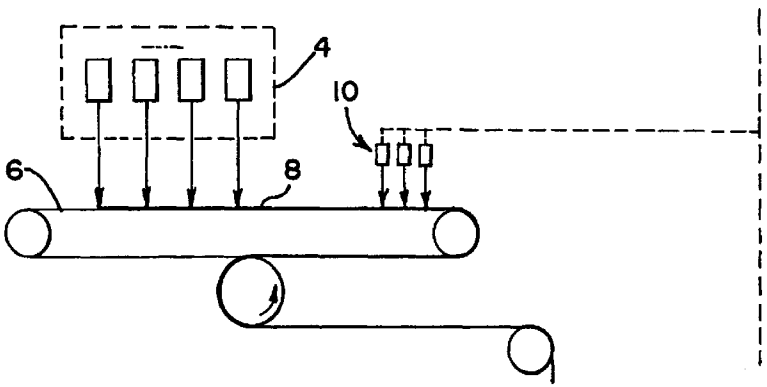
FIG. 3D is a schematic view of another embodiment of the invention.
Figure 3A:
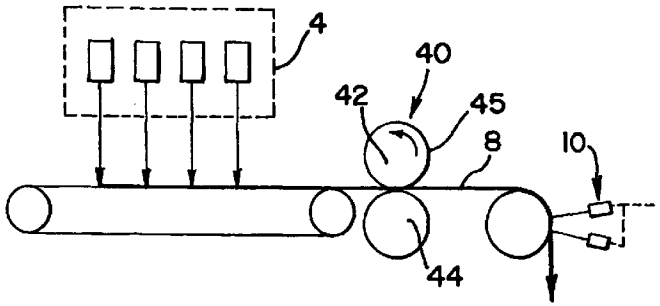
FIG. 3A is a schematic view of another embodiment of the invention.
Figure 3C:
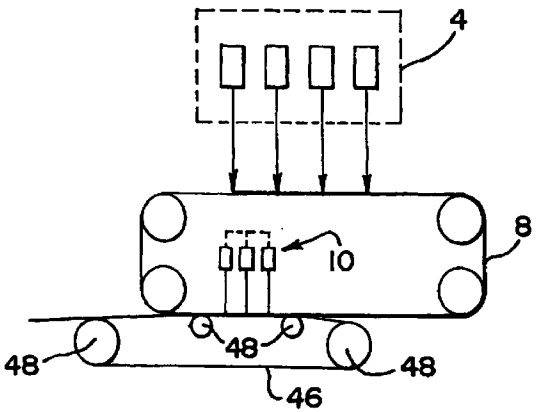
FIG. 3C is a schematic view of another embodiment of the invention.

FIG. 2 shows another embodiment of the apparatus and process of the invention. In this embodiment, pre-entangling station 10 is comprised of two individual sets of pre-entangling water jets 12, and web 8 is supported through pre-entangling on porous forming drum 30. Use of forming drum 30 is preferred for webs of a basis weight over 50 gm/m$^2$, when higher pre-entangling hydraulic pressures are used. As discussed, forming drum 30 preferably has a three dimensional forming surface 32.

A preferred forming drum and a method for using are described in U.S. Pat. Nos. 5,244,711 and 5,098,764, incorporated herein by reference. In these references, an apertured drum is provided with a three dimensional surface in the form of pyramids, with the drainage apertures being located at the base of the pyramids. Many other configurations for the surface of the drum are also feasible. Although these references disclose the hydroentanglement of staple fibers to produce knotted, apertured fabrics, it has been found that these drums may likewise be used with the continuous pre-entangled filament webs of the present invention.

FIG. 3 shows additional embodiments of the pre-entanglement portion of the process and apparatus of the present invention. In FIG. 3A, calender 40 provides light thermal bonding to web 8 prior to pre-entanglement at pre-entangling station 10. Preferred calender 40 comprises heated rollers 42 and 44, with surface 45 of roller 42 having a pattern for embossing on web 8. FIG. 3B shows pre-entanglement station 10 entangling web 8 with web 8 supported by forming wire 6. Note that forming drum 30 is used to restrain forming wire 6. FIG. 3C shows web 8 being supported between forming wire 6 and a second wire 46 rotating about rollers 48. Also, as shown in FIG. 3D, pre entangling station 10 may be positioned directly in line with filament attenuator 4 with web 8 supported by forming wire 6.

Figure 4:
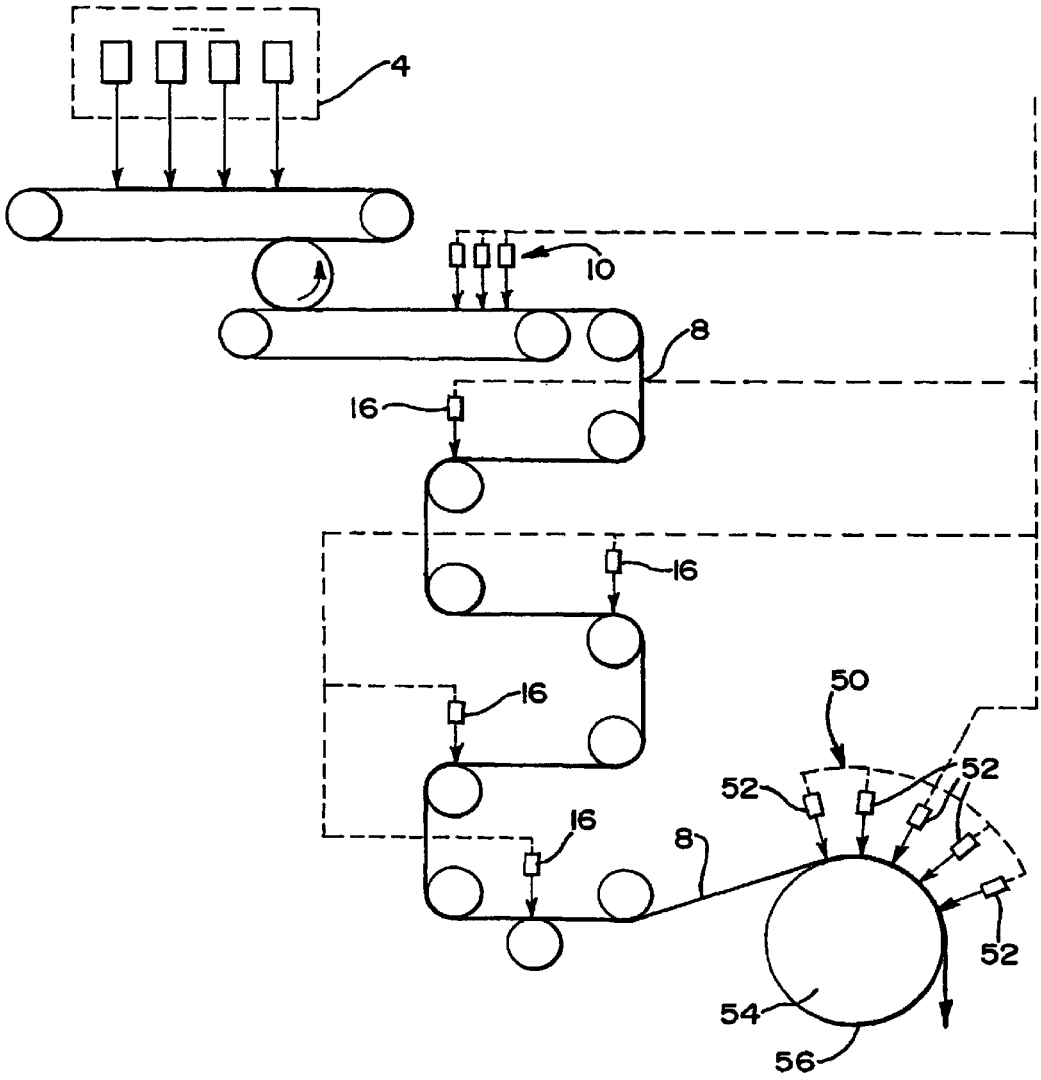
FIG. 4 is a schematic view of another embodiment of the invention.

FIG. 4 shows another embodiment of the apparatus and process of the invention, further comprising pattern imparting station 50. Pattern imparting station 50 comprises rotating patterning drum 54, with three dimensional surface 56, and pattern water jets 52. A plurality of jets 52 are provided, each with a plurality of individual jet streams, operating at pressures that may be varied depending on the basis weight of the web and the detail of the pattern to be embossed. Generally, jets 52 operate at 2000–3000 psi for webs of a basis weight less than 50 gm/m$^2$, and at 3000–6000 psi for heavier webs.

Figure 5A:
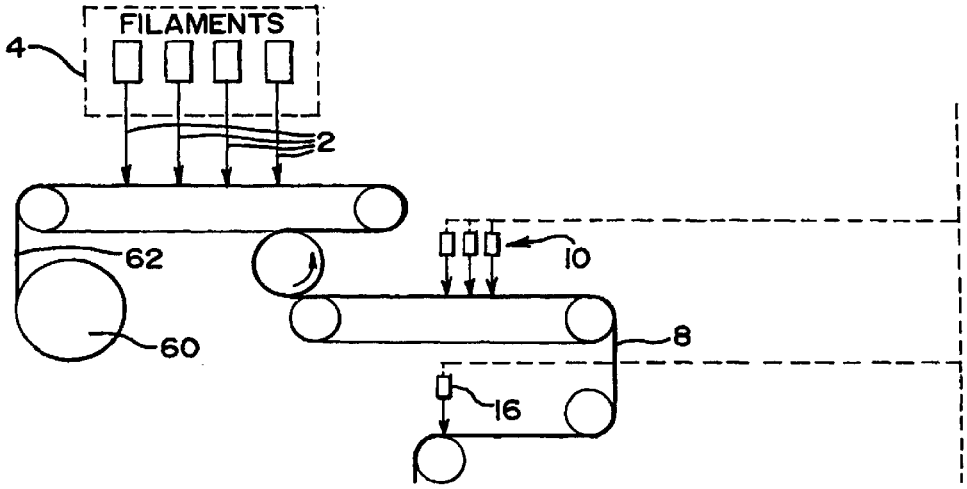
FIG. 5A is a schematic view of another embodiment of the invention.
Figure 5B:
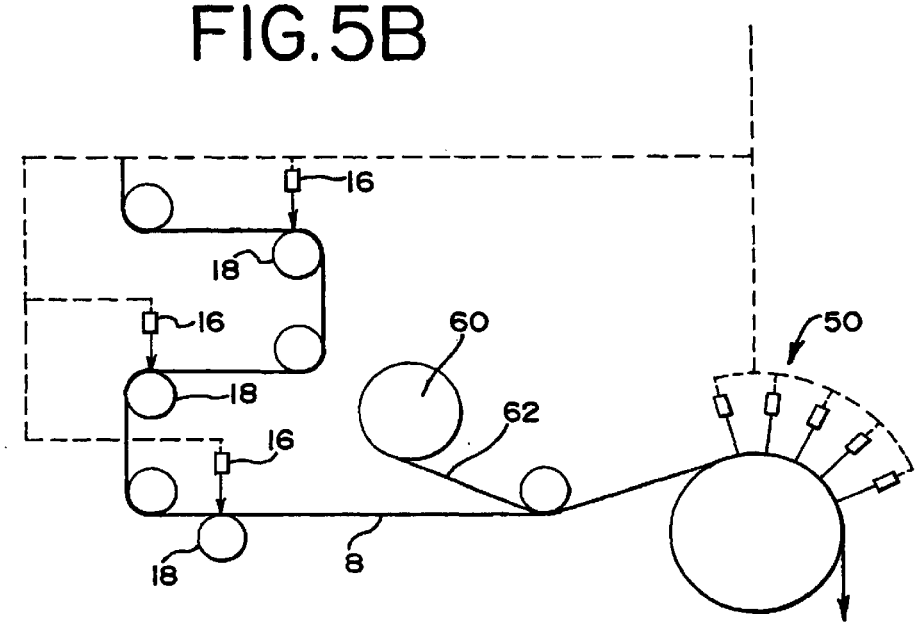
FIG. 5B is a schematic view of another embodiment of the invention.

FIGS. 5A and 5B show additional embodiments of the apparatus and process of the invention where a secondary web is introduced. The secondary web may comprise carded staple fibers, meltblown fibers, synthetic or organic pulps, or the like. FIG. 5A shows roller 60 dispensing secondary web 62 upstream of attenuator 4, so that filaments 2 will be deposited onto secondary web 62. Secondary web 62 is thus entangled with filaments 2 through downstream pre-entangling station 10 and downstream entangling jets 16. FIG. 5B shows secondary web 62 being dispensed from unroller 66 downstream of entangling jets 16, and upstream of patterning station 50. Secondary web 62 and web 8 are entangled in this embodiment at patterning station 50.

The preferred nonwoven fabric of the present invention comprises a web of continuous, substantially endless polymer filaments of 0.5–3 denier, with 1–2.5 denier most preferred, interengaged by continuous complex loops or spirals, with the filaments being substantially free of any wrapping, knotting, breaking, or severe bending. As discussed infra, the terns "knot" and "knotting" as used herein are in reference to a condition in which adjacent fibers or filaments pass around each other more than about 360° to form mechanical bonds in the fabric. Knotting occurs to a substantial degree in conventional hydroentangled fabrics made from staple fibers.

The hydroentangled continuous webs of substantially endless filaments that comprise the fabric of the present invention, on the other hand, are substantially free from such knotting. The mechanical bonding of the fabric of the present invention is characterized by enmeshed coils, spirals, and loops having a high frequency of contact points to provide high tensile strength, while the coils and loops are capable of release at higher load. This results in high cross direction elongation values for the fabric of the invention that are preferably in excess of 90%, and more preferably in excess of 100%. A preferred machine direction elongation value is at least 75%. The combination of high elongation and tensile strength is a novel and surprising result, as conventional hydroentangled fabrics because of fiber knotting have an inverse proportional relationship between tensile strength and elongation: high strength fabrics tend to have lower elongation than fabrics of comparable weight with lower tensile strength. The preferred fabric of the present invention, on the other hand, enjoys a proportional relationship between elongation and tensile strength: as fabric elongation increases, in either the CD or MD, tensile strength (in the same direction) likewise increases.

The non-woven fabric of the present invention is preferably comprised of a polyamide, polyester, or polyolefin such as polypropylene. In addition, the fabric of the invention may comprise secondary component filaments including, but not limited to, staple polymer fibers, wood or synthetic pulp, and meltblown fibers. The secondary filaments may comprise between 5% and 95% by weight of the fabric of the invention. Also, the fabric of the invention may comprise a surface treatment such as an antistat, antimicrobial, binder, or flame retardant. The fabric of the invention preferably has a basis weight of between about 20 and 450 gm/m$^2$.

Figure 6:
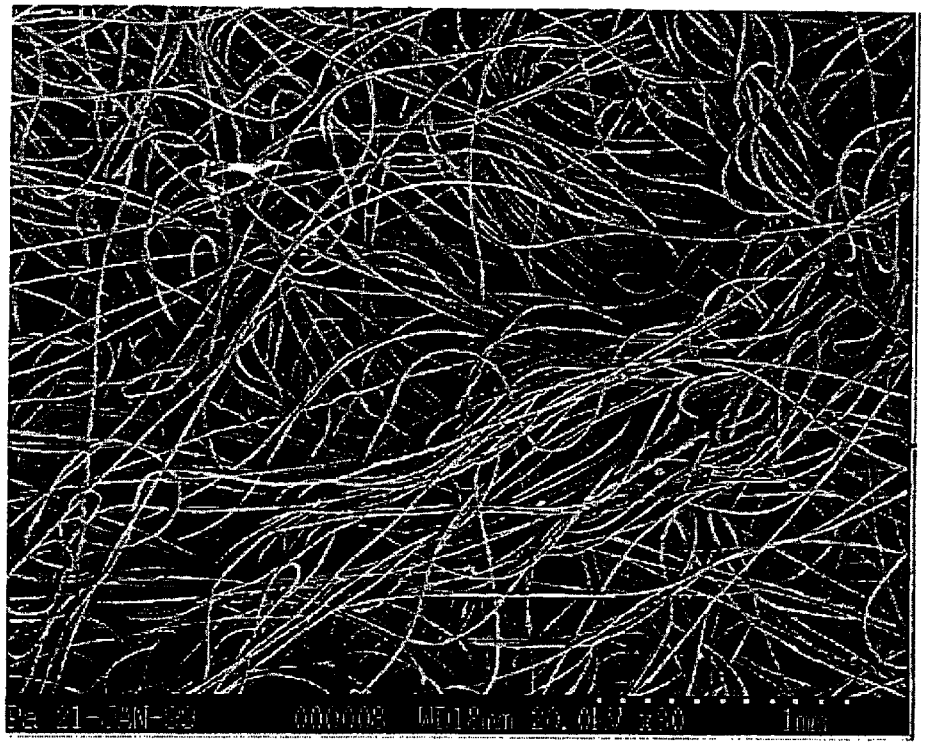
FIG. 6 is a 30× photomicrograph of an embodiment of the fabric of the invention.
Figure 7:
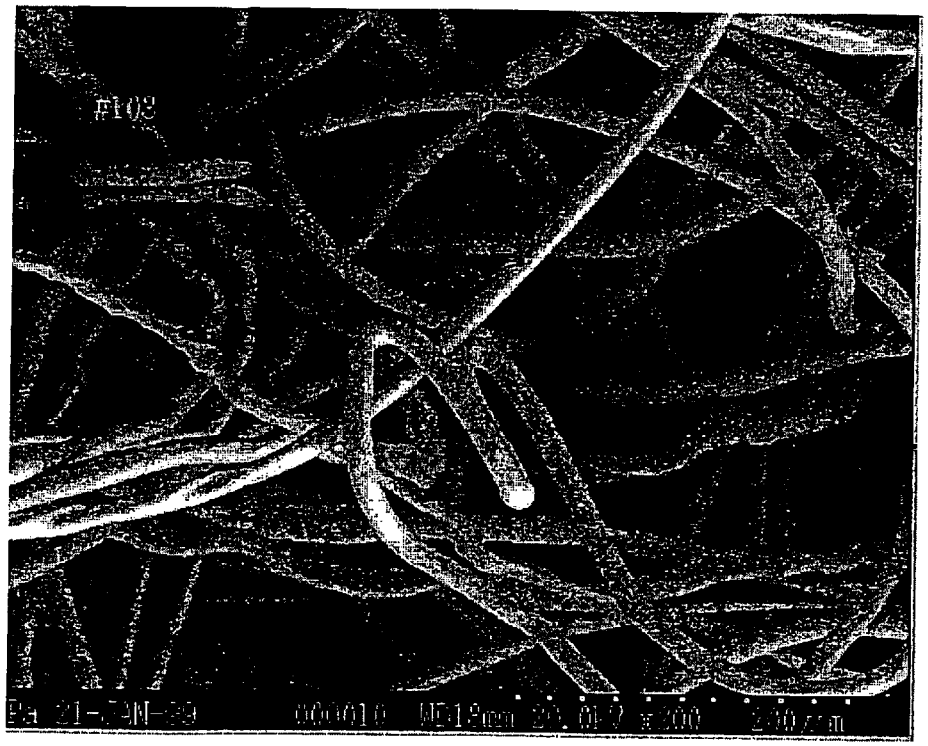
FIG. 7 is a 200× photomicrograph of an embodiment of the fabric of the invention.
Figure 8:
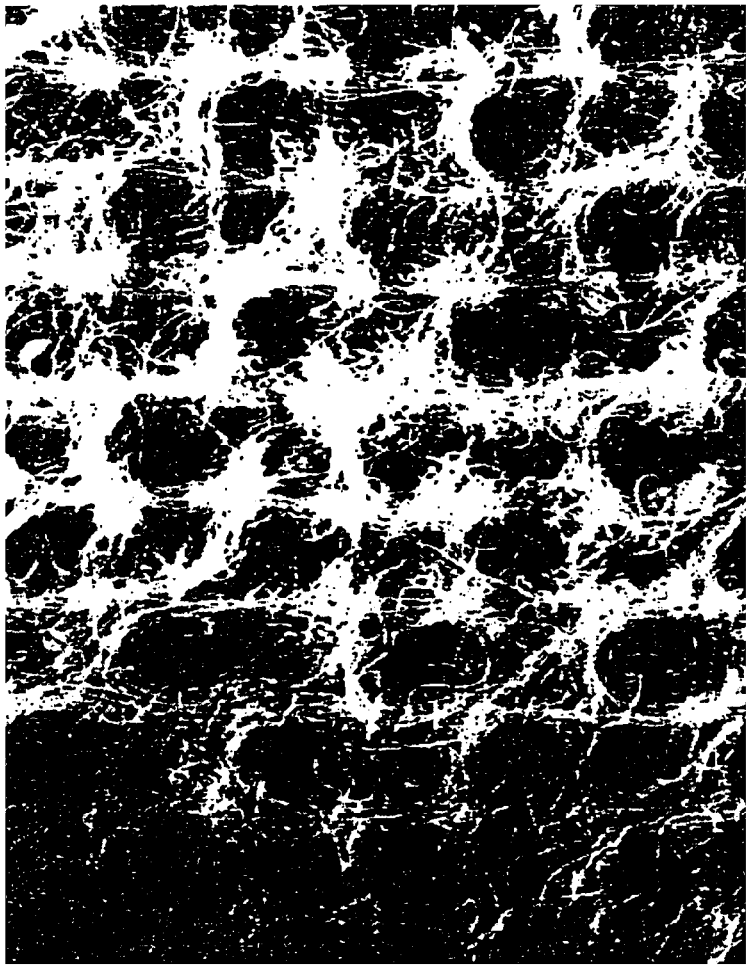
FIG. 8 is a 10× photomicrograph of a prior art hydroentangled staple fiber web.
Figure 9:
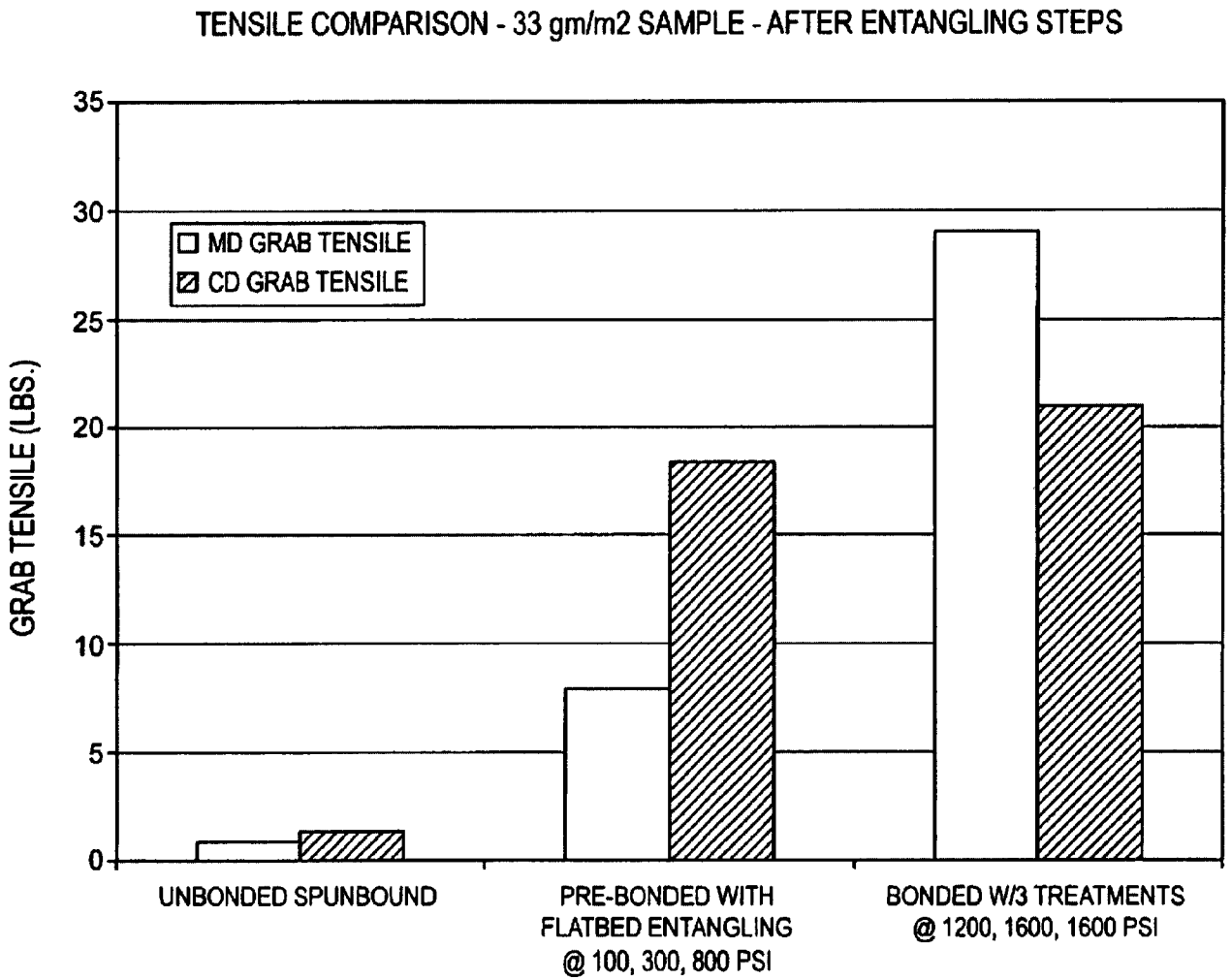
FIG. 9 shows Grab Tensile strength for various webs.
Figure 10:
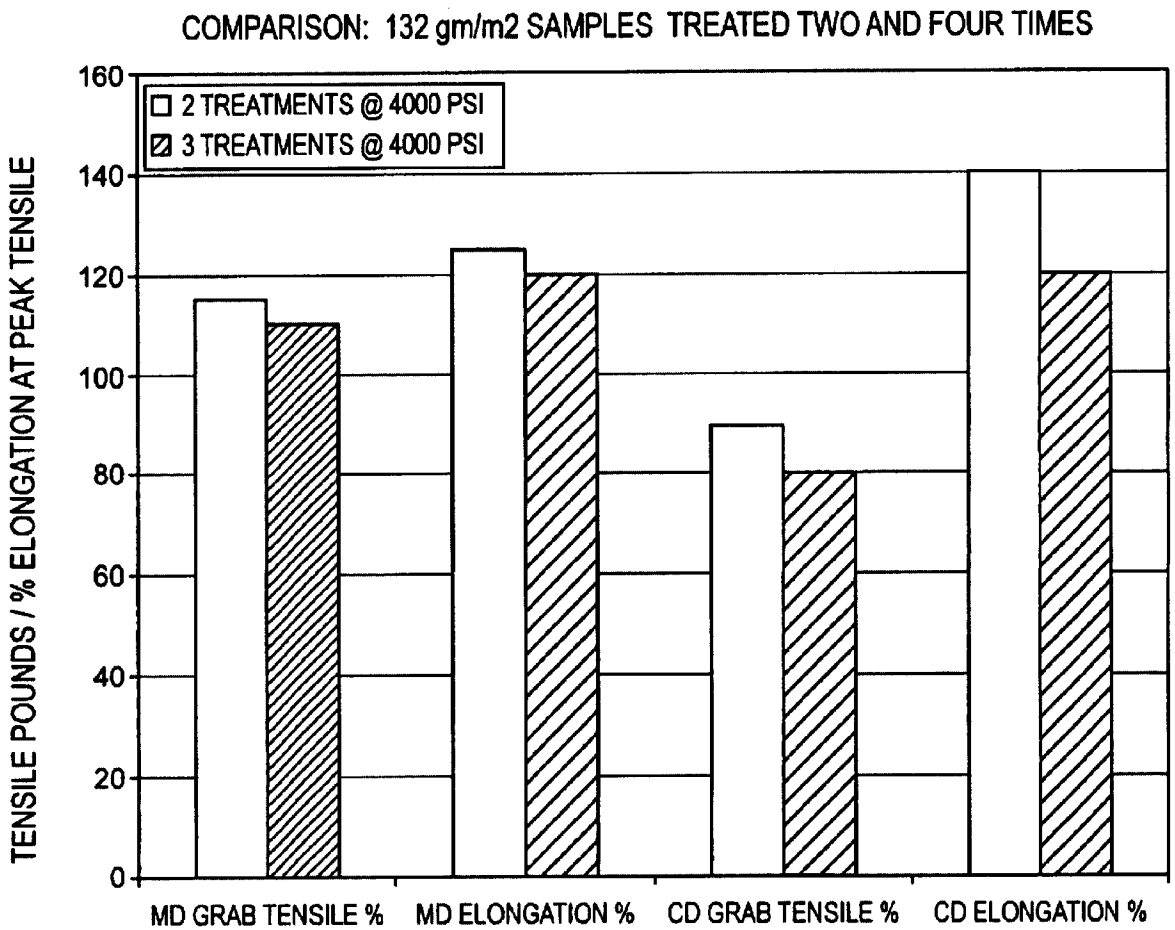
FIG. 10 shows Tensile pounds/% Elongation at Peak Tensile for various webs.
Figure 11:
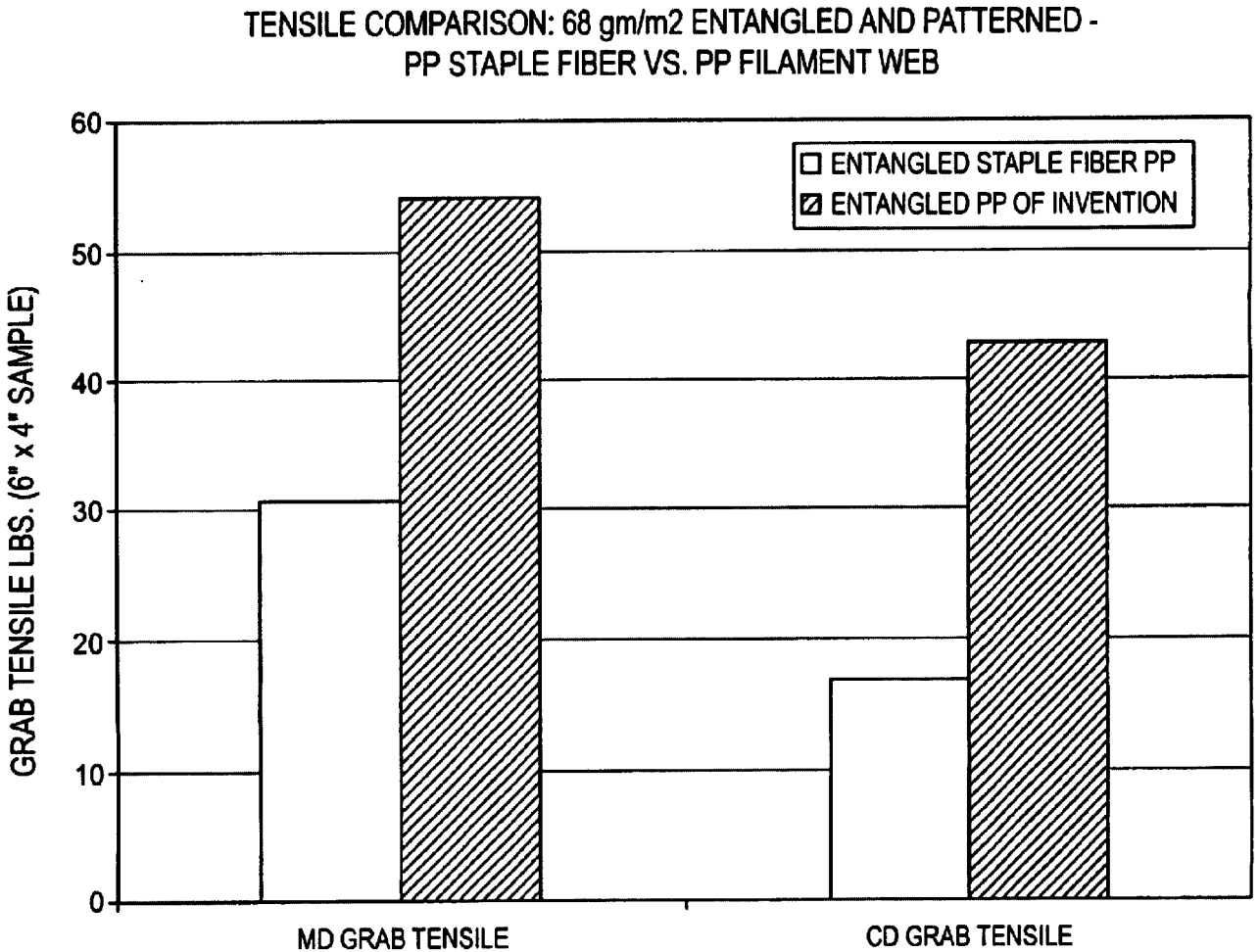
FIG. 11 shows Grab Tensile pounds for 6"×4" samples for various webs.

FIG. 6 is a photomicrograph of an embodiment of the fabric of the invention at 30× magnification. This fabric sample is comprised of 1.7 denier polypropylene continuous fibers with a fabric basis weight of 68 gm/m$^2$. As evident in the photomicrograph FIG. 6, the fabric of the invention has filament mechanical bonding characterized by winding interengaged spiral coils and loops, and is substantially free of filament knotting or breaking. FIG. 7 is a photomicrograph of the same sample at 200× magnification. The three dimensional characteristic of the interengaged loops and spirals is more clearly shown by the increased magnification of FIG. 7. FIGS. 6 and 7 are contrasted with FIG. 8, which is a photomicrograph of a hydroentangled web of the prior art comprised of staple PET/Rayon fibers. As can be seen in FIG. 8, the hydroentangled web of the prior art shows numerous free fiber ends, as well as a high occurrence of fibers wrapped about one another and otherwise knotted.

The appearance and properties of the fabric are believed to be unique as the continuous filaments are substantially immobile in the fabric and do not substantially individually reduce in length along the filament axis or in the general cross or machine directional width of the fibrous web during the hydroentanglement process. In contrast, during the hydroentanglement of staple fibers, the loose ends of the fibers allow them to freely alter their spatial arrangement in the web, in the process of wrapping around themselves or neighboring fibers, forming knots from the interlaced fibers. This wrapping and knotting can lead to observable streaks and thin spots. The complex packing of the loops and coils of the fabric of the present invention, on the other hand, provides better randomization of the filaments, resulting in a more consistent fabric and better aesthetics. The fabric of the invention thus has a distinctive and commercially advantageous uniform fabric appearance.

The nonwoven fabric of the present invention may further comprise a secondary chemical treatment to modify the surface of the final fabric. Such treatments may comprise spray, dip, or roll applications of wetting agents, surfactants, fluorocarbons, antistats, antimicrobials, flame retardants, or binders. Further, the fabric of the present invention may comprise a secondary web entangled with the web of the invention, such a secondary web may comprise prefabrics, pulps, staple fibers or the like, and may comprise from 5–95% on a weight basis of the composite fabric.

After the final entanglement steps, the fabric is dried using methods well known to those skilled in the art, including passage over a heated dryer. The fabric may then be wound into a roll. In order to achieve the superior physical properties of the product of the present invention, no additional bonding, such as thermal or chemical bonding, is required.

As defined herein, the fabric of the present invention has a fiber entanglement frequency of at least 10.0, a fiber entanglement completeness value of at least 1.00, and a fiber interlock value of at least 15.

The fabrics of the present invention have many applications. They may, for example, be used in the same applications as conventional fabrics. In particular, the nonwoven fabric of the present invention may find particular utility in applications including absorbent articles, upholstery, and durable, industrial, medical, protective, agricultural, or recreational apparel or fabrics.

A first sample fabric of the invention was prepared using the process and apparatus generally described infra and shown in FIG. 1. The sample was prepared using 2.2 denier polypropylene filament, with a web basis weight of 32 gm/m$^2$. The sample was prepared using three pre-entanglement jets 12 of FIG. 1 operating sequentially at 100, 300, and 800 psi; and with three entanglement jets 16 operating sequentially at 1200, 1600, and 1600 psi. To demonstrate the effect of each stage of entanglement, grab tensile strength was measured after initial filament deposit, pre-entanglement, and entanglement, with the results shown in Chart 1. The profound effect of the high pressure entanglement jets is demonstrated in the results.

A set of two sample fabrics of the invention was likewise prepared with 2.2 denier polypropylene filament of a basis weight of 132 gm/m$^2$. The fabrics were prepared using the apparatus and process as described infra and shown in FIG. 1, with the pre-entanglement jets operating sequentially at 25, 500, and 1200 psi. For one of the two fabrics, two entanglement jets were used operating at 4000 psi. For the second fabric, four entanglement jets were used, also operating at 4000 psi. The results of grab tensile and elongation testing of these samples are presented in Chart 2. It is noted that the sample prepared using two entanglement jets showed better properties.

A third sample fabric of the invention with a 68 gm/m$^2$ basis weight was made using the apparatus as generally shown in FIG. 1 using polypropylene. For comparison, a "control" fabric of the same basis weight and denier was prepared using the apparatus as shown in FIG. 1, but with short staple fibers replacing the continuous filaments of the present invention. Grab tensile strengths of the two fabrics were tested, with results shown in Chart 3. The superiority of the fabric of the invention over the more traditional hydroentangled staple fiber fabric is clearly shown.

In order to further define the fabric of the invention and its various advantages, a first series of fabrics of the invention were prepared using the process and apparatus as described herein. It is noted that the fabrics of the present invention may be referred to as "Spinlace", which is a trademark of the Polymer Group, Inc. A second series of fabrics was prepared for comparison, consisting of hydroentangled carded staple fibers entangled by a traditional hydroentanglement process. The fabrics of the first and second series were both of basis weights between about 34 and 100 gm/m$^2$, and both were made using polypropylene fibers and filaments of similar denier. The fabrics of the first and second series were then tested according to standard methods as known by those skilled in the art for basis weight, density, abrasion resistance (Taber—abrasion resistance is measured by pressing the fabric down upon an rotating abrasion disc at a standard load), grab tensile, strip tensile, and trapezoid tear. The test methods used and characteristics tested for are described generally in U.S. Pat. No. 3,485,706 to Evans, herein incorporated by reference.

Three other qualities were also tested, including entanglement completeness (a measure of the proportion of the fibers that carry the stress when tensile forces, are applied, see below), entanglement frequency (a measure of the surface stability, entanglement frequency per inch of fiber, see below), and fiber interlock (a measure of how the fibers resist moving when subjected to tensile forces, see below). Results of testing are presented in Table 1. Note that "Apex" is a trademark of the Polymer Group, Inc., and as used in Table refers to a pattern drum having a three dimensional surface. Also, and also that the "flatbed and roll" process/pattern is most preferred.

Fiber Interlock test: The fiber interlock value is the maximum force in grams per unit fabric weight needed to pull apart a given sample between two hooks.

Samples are cut ½ inch by ½ inch (machine direction or cross direction), weighed, and marked with two points one-half inch apart symmetrically along the midline of the fabric so that each point is ¼ inch from the sides near an end of the fabric.

The eye end of a hook (Carlisle six fishhook with the barb ground off, or a hook of similar wire diameter and size) is mounted on the upper jaw of an Instron tester so that the hook hangs vertically from the jaw. This hook is inserted through one marked point on the fabric sample. The second hook is inserted through the other marked point on the sample, and the eye end of the hook is clamped in the lower jaw of the Instron. The two hooks are now opposed but in line, and hold the samples at one half inch interhook distances.

The Instron tester is set to elongate the sample at one-half inch per minute (100% elongation per minute) and the force in grams to pull the sample apart is recorded. The maximum load in grams divided by the fabric weight in grams per square meters is the single fiber interlock value.

The fabric of the invention preferably has a fiber interlock value of at least 15.

Entanglement Frequency/Completeness tests: In these tests, nonwoven fabrics are characterized according to the frequency and completeness of the fiber entanglement in the fabric, as determined from strip tensile breaking data using an Instron tester.

Entanglement frequency is a measure of the frequency of occurrence of entanglement sites along individual lengths of fiber in the nonwoven fabric. The higher the value of entanglement frequency the greater is the surface stability of the fabric, i.e., the resistance of the fabric to the development of piling and fuzzing upon repeated laundering.

Entanglement completeness is a measure of the proportion of fibers that break (rather than slip out) when a long wide strip is tested. It is related to the development of fabric strength.

Entanglement frequency and completeness are calculated from strip tensile breaking data, using strips of the following sizes:

| | Strip Width (in.) | Instron Gage Length (in.) | Elongation Rate (in./min.) |
|---|---|---|---|
| #0 | 0.8 ("$w_1$") | 0 | 0.5 |
| #1 | 0.3 ("$w_2$") | 1.5 | 5 |
| #2 | 1.9 ("$w_3$") | 1.5 | 5 |

In cutting the strips from fabrics having a repeating pattern or ridges or lines or high and low basis weight, integral numbers of repeating units are included in the strip width, always cutting through the low basis weight proportion and attempting in each case to approximate the desired width closely. Specimens are tested at #1, #2, and #3 using an Instron tester with standard rubber coated, flat jaw faces with the gage lengths and elongation rates list above. Average tensile breaking forces from each width (#0, #1, and #3) are correspondingly reported as $T_0$, $T_1$, and $T_2$. It is observed that:

$$\frac{T_2}{w_2} \geq \frac{T_1}{w_1} \geq \frac{T_0}{w_0}$$

It is postulated that the above inequalities occur because:

(1) there is a border zone of width D at the cut edges of the long gauge length specimens, which zone is ineffective in carrying stress; and (2) with zero gauge length, fibers are clamped jaw-to-jaw and ideally all fibers carry stress up to the breaking point, while with long gage length, some poorly-entangled fibers slip out without breaking. A measure of the proportion of stress-carrying fibers is called C.

Provided that D is less than ½ $W_1$, then:

$$\frac{T_1}{w_1 - 2D} = \frac{T_2}{w_2 - 2D} = C\frac{T_0}{w_0}$$

and D and C are:

$$D = \frac{w_1 T_2 - w_2 T_1}{2(T_2 - T_1)}$$

$$C = \frac{T_2 - T_1}{w_2 - w_1} \times \frac{w_0}{T_0}$$

In certain cases D may be nearly zero and even a small experimental error can result in the measured D being negative. For patterned fabrics, strips are cut in two directions: A in the direction of pattern ridges or lines of highest basis weight (i.e., weight per unit area), and B in the direction at 90° to the direction specified in A. In unpatterned fabrics any two directions at 90° will suffice. C and D are determined separately for each direction and the arithmetic means of the values for both directions, are determined separately for each direction and the arithmetic means of the values for both directions $\overline{C}$ and $\overline{D}$ are calculated. $\overline{C}$ is called the entanglement completeness.

When $\overline{C}$ is greater than 0.5, $\overline{D}$ is a measure of the average distance required for fibers in the fabric to become completely entangled so that they cannot be separated without breaking. When $\overline{C}$ is less than 0.5, it has been found that $\overline{D}$ may be influenced by factors other than entanglement. Accordingly, when $\overline{C}$ is less than 0.5, calculation of $\overline{D}$ as described above may not be meaningful.

From testing various samples, it is observed that the surface stability of a fabric increases with increasing product of $\overline{D}^{-1}$ and the square root of fiber denier d. Since 1.5 denier fibers are frequently used, all deniers are normalized with respect to 1.5 and entanglement frequency f per inch is defined as $$f = (\overline{D}^{-1}\sqrt{d}\sqrt{1.5})$$

If the fabric contains fibers of more than one denier, the effective denier d is taken as the weighted average of the deniers.

If the measured $\overline{D}$ turns out to be zero or negative, it is proper to assume that the actual $\overline{D}$ is less than 0.01 inch and f is therefore greater than $(100\sqrt{d}\sqrt{1.5})$per inch.

The fabric of the invention preferably has a fiber entanglement frequency f of at least 10.0, and a fiber interlock completeness of at least 1.00.

As shown in Table 1, for the Spinlace fabrics of the invention the entanglement completeness values trend higher than for the hydroentangled staple fiber webs (HET). It is believed that these superior properties are a result of the complexity of the interengaged loop and spiral matrix formed by the continuous filaments. Grab tensile values for Spinlace are about two times that of the hydroentangled staple fiber webs. Trap tear values for all of the Spinlace fabrics exceed those of the traditional fabrics. It is believed that this is a result of the randomness of the fiber matrix of the Spinlace fabrics that confounds the fault lines that more quickly lead to failures in this test for other fabrics. This is also further evidence that the complex entangling of the continuous filaments of the Spinlace fabrics of the present invention comprises substantially superior and distinct mechanical bonding and disengagement from that of the traditional entangling of cut staple fibers.

Strip tensile values are highest for the Spinlace fabrics, regardless of sample basis weight. Note the novel high elongation values that are in combination with the high tensiles of the Spinlace. This is in agreement with the observations of the fabrics during testing. During testing, Spinlace fabric test samples were observed to initially resist the applied tensile stress, and then to gradually release the tension by popping fibers loose from the matrix. Tests of traditional fabrics, on the other hand, were observed to experience fiber and bond breakage, leading to shorter elongation values. As discussed infra, the concomitant high strength and high elongation of the fabric of the present invention represent an unexpected and novel property.

The advantages of the disclosed invention are thus attained in an economical, practical, and facile manner. While preferred embodiments and example configurations have been shown and described, it is to be understood that various further modifications and additional configurations will be apparent to those skilled in the art. It is intended that the specific embodiments and configurations herein disclosed are illustrative of the preferred and best modes for practicing the invention, and should not be interpreted as limitations on the scope of the invention as defined by the appended claims.

What is claimed is:

1. A nonwoven fabric consisting of comprising of substantially endless thermoplastic melt extruded spunbond filaments having a denier of about 0.5 to 3, wherein said filaments are collected and thereafter hydroentangled in the form of interengaged packed loop, with the filaments being substantially free of breaking, wrapping, and knotting, and wherein said hydroentangled fabric has a cross machine elongation value in excess of 100% as meshed coils and said loops of said filaments disengage and elongate under a load.

2. A nonwoven fabric as in claim 1, wherein said filaments have a denier of about 1.0 to 2.5.

3. A nonwoven fabric as in claim 1, where sad thermoplastic melt extruded filaments comprise plyolefins, polyamide, or polyesters.

4. A nonwoven fabric as in claim 1, wherein said nonwoven fabric has a basis weight of between about 20 and 450 $g/m^2$.

5. A nonwoven fabric as in claim 1, wherein said fabric has a machine direction elongation value of at least 75% and a cross-direction elongation value of at least 100%.

6. A nonwoven fabric as in claim 1, wherein said fabric has a fiber entanglement frequency of at least 10.0, and a fiber entanglement value of at least 1.00.

7. A nonwoven fabric as in claim 1, wherein said fabric has a fiber interlock value of at least 15.

8. A nonwoven fabric as in claim 1, wherein said continuous web of substantially endless thermoplastic melt extruded filaments comprises a plurality of layers of said web of substantially endless continuous filaments.

9. A nonwoven fabric as in claim 1, wherein said interengaged packed loops provide a structure wherein cross-direction elongation is directly proportional to cross-directional tensile strength.

10. A nonwoven fabric consisting of substantially endless melt extruded thermoplastic spunbond filaments having a denier of about 1.0 to 2.5, wherein said filaments are collected and thereafter hydroentangled in the form of interengaged packed loops, with the filaments being substantially free of breaking, wrapping, and knotting; said fabric having a basis weight of between about 10 and 450 $gm/m^2$, having a machine direction elongation value of at least 75% and across direction value of at least 100% having a fiber entanglement frequency of at least 10.0, a fiber entanglement completeness value of at least 1.00, a fiber interlock value of at least 15, said fabric elongating as meshed coils and loops of said filaments disengage and said filaments straighten and elongate under a load.

* * * * *

UNITED STATES PATENT AND TRADEMARK OFFICE

CERTIFICATE OF CORRECTION

PATENT NO. : 7,091,140 B1
APPLICATION NO. : 09/287673
DATED : August 15, 2006
INVENTOR(S) : Richard Ferencz et al.

It is certified that error appears in the above-identified patent and that said Letters Patent is hereby corrected as shown below:

In column 12, line 62, delete the words “comprising of”;
In column 12, line 66, “loop” should be --loops--;
In column 13, line 6, “sad” should be --said--;
In column 13, line 7, “plyolefins” should be --polyolefins--.

Signed and Sealed this

Twenty-ninth Day of May, 2007

JON W. DUDAS
*Director of the United States Patent and Trademark Office*